US009234414B1

(12) United States Patent
Zaid et al.

(10) Patent No.: US 9,234,414 B1
(45) Date of Patent: Jan. 12, 2016

(54) PRESSURIZED INJECTION APPARATUS FOR DOWNHOLE TREATMENT PELLETS

(71) Applicant: Jacam Chemical Company 2013, LLC, Sterling, KS (US)

(72) Inventors: Gene H. Zaid, Sterling, KS (US); Byron G. Owen, Sterling, KS (US); Ivan Clark Barr, Great Bend, KS (US)

(73) Assignee: Jacam Chemical Company 2013, LLC, Sterling, KS (US)

( * ) Notice: Subject to any disclaimer, the term of this patent is extended or adjusted under 35 U.S.C. 154(b) by 140 days.

(21) Appl. No.: 14/256,788

(22) Filed: Apr. 18, 2014

(51) Int. Cl.
*E21B 43/25* (2006.01)
*E21B 43/16* (2006.01)

(52) U.S. Cl.
CPC *E21B 43/25* (2013.01); *E21B 43/16* (2013.01)

(58) Field of Classification Search
CPC ..... E21B 43/24; E21B 43/16
See application file for complete search history.

(56) References Cited

U.S. PATENT DOCUMENTS 2,790,500 A 4/1957 Jones
3,378,074 A * 4/1968 Kiel ..... C09K 8/64 137/13
3,722,595 A * 3/1973 Kiel ..... C09K 8/64 166/308.4
4,007,791 A * 2/1977 Johnson ..... C09K 8/592 166/272.1
6,135,207 A 10/2000 Zaid et al.
6,949,491 B2 * 9/2005 Cooke, Jr. ..... C09K 8/62 507/219
7,694,731 B2 * 4/2010 Decker ..... E21B 43/164 166/177.5
7,946,342 B1 * 5/2011 Robertson ..... C09K 8/58 166/263
2003/0060374 A1 * 3/2003 Cooke, Jr. ..... C09K 8/62 507/200
2010/0059226 A1 * 3/2010 Termine ..... C09K 8/66 166/308.1
2011/0277996 A1 * 11/2011 Cullick ..... E21B 33/138 166/250.12

* cited by examiner

*Primary Examiner* — Shane Bomar
(74) *Attorney, Agent, or Firm* — Hovey Williams LLP

(57) ABSTRACT

Apparatus (10) permits injection of solid well treatment pellets into a producing well (25) having a positive well pressure. The apparatus (10) includes a water storage tank (12) connected to the input of a high pressure pump (14). The pump (14) generates a pressurized flow of water at a pressure greater than well pressure through a conduit (24) and/or through a container (30) holding the pellets to be injected. The pellets are entrained within the pressurized flow of water for well injection.

10 Claims, 2 Drawing Sheets

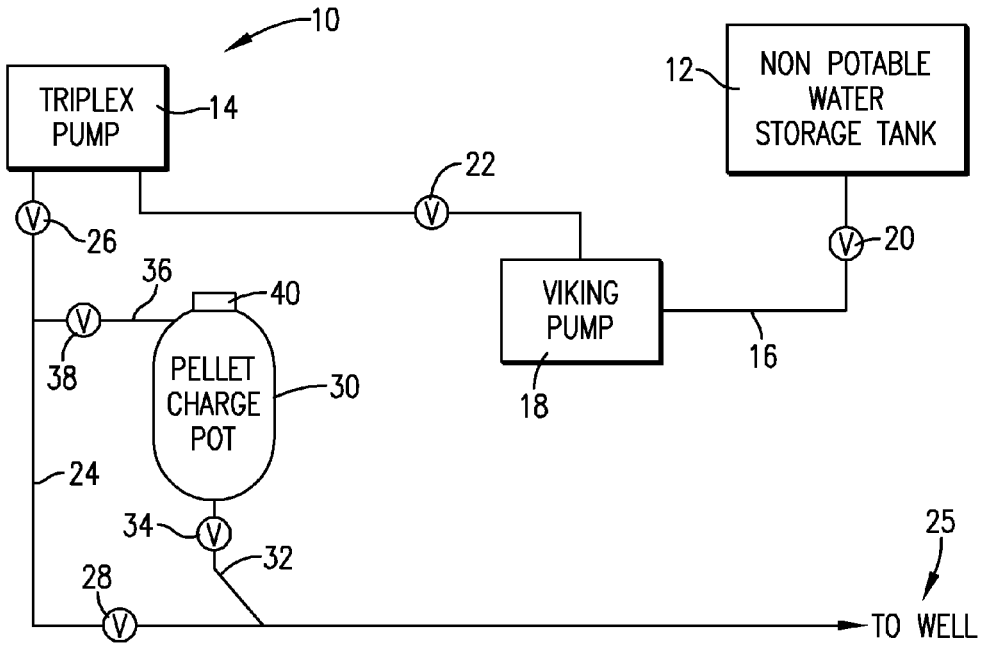
FIG. 1.
FIG. 2.
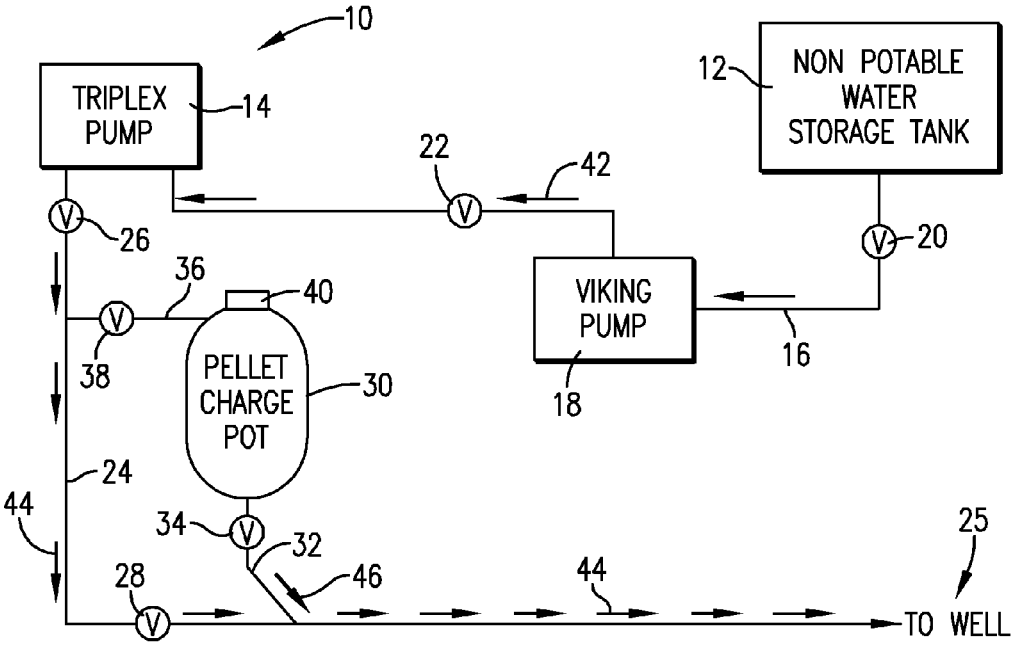

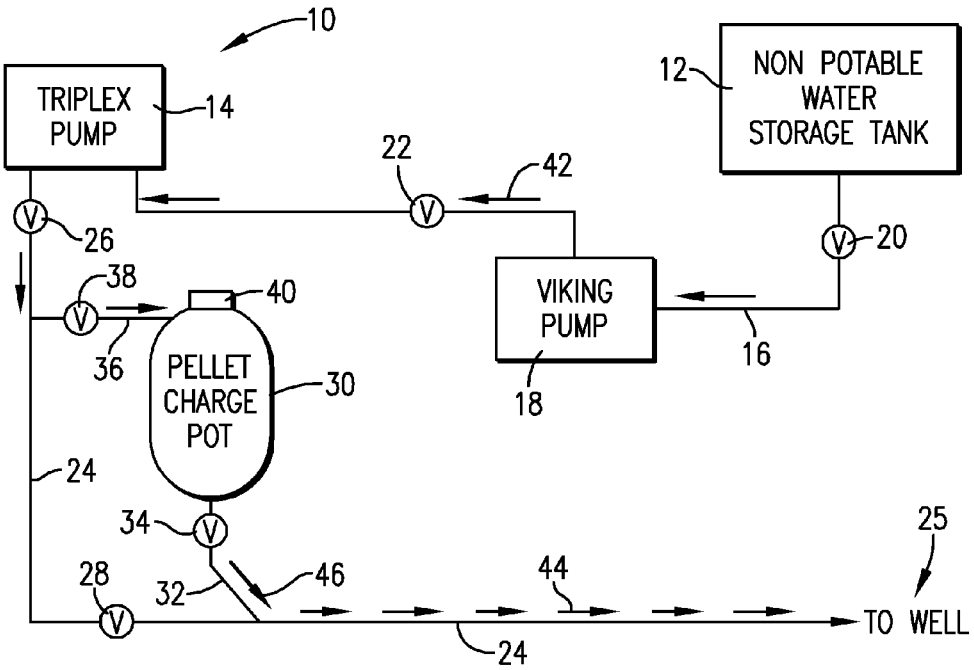
FIG. 3.
FIG. 4.
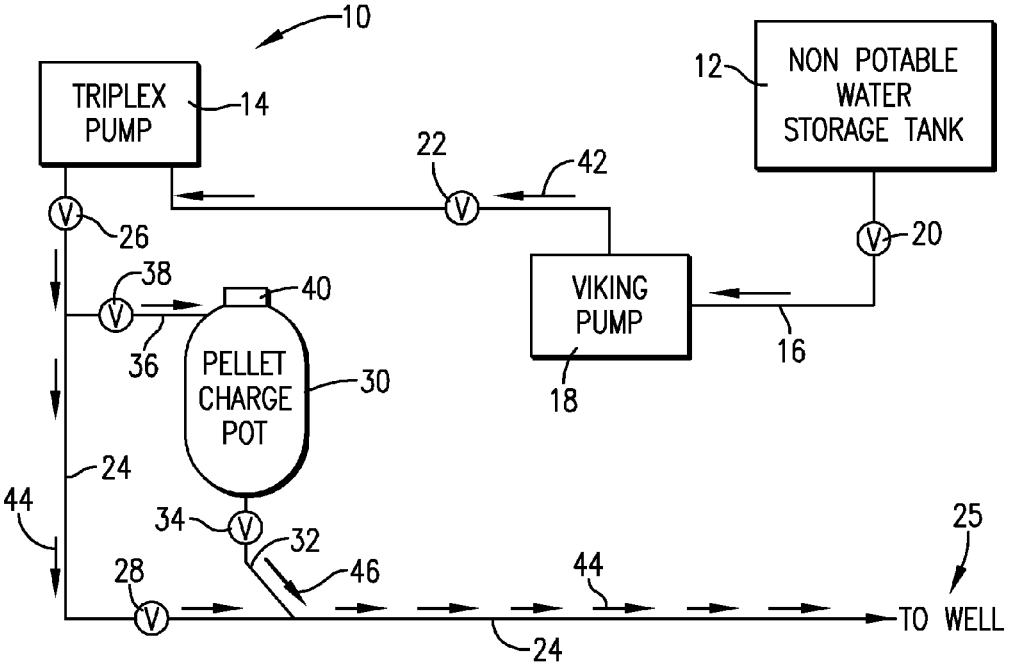

PRESSURIZED INJECTION APPARATUS FOR DOWNHOLE TREATMENT PELLETS

BACKGROUND OF THE INVENTION

1. Field of the Invention

The present invention is broadly concerned with improved apparatus and methods for the injection of solid treatment pellets into producing oil and gas wells. More particularly, the invention is concerned with such apparatus and methods which make use of high pressure liquid flow serving to entrain solid pellets from a source thereof, for ultimate delivery to the producing well. The apparatus may advantageously be truck-mounted so that pellets of the desired type may be easily injected at the well head.

2. Description of the Prior Art

Oil and gas wells sometimes require the periodic addition of treatment agents, such as scale and corrosion inhibitors, in order to facilitate smooth, trouble-free operations. Such agents are often in liquid form, and are commonly added into the annular space between the well sidewall and the internal well casing. Well operators use a number of expedients for such additions, such as introduction through a side arm flush associated with the well fluid removal system. Because conventional treating agents tend to float on the well fluid, it is a common practice to add excess well fluid after addition of the treatment agent in order to drive the agent downwardly to a subterranean level adjacent the lower end of the well casing. As can be appreciated, this practice largely or completely shuts down well production, and it is not uncommon to thereby lose an entire day's production during the treatment process.

Solid treatment composites in the form of pellets or the like have also been utilized to provide a method for downhole treatment. For example, mold inhibitors such as the commercial product Iconol NP-100 Pastille FD (a nonylphenol ethoxylate available from BASF Corp.) have been mixed with active ingredients (such as corrosion inhibitors or bactericides) and formed into pellets. Also, U.S. Pat. No. 6,135,207 describes solid, self-sustaining well-injection pellets which can be formulated as corrosion and/or scale inhibitors, bactericides, or foaming agents. Pellets of this type have been commercialized by Jacam Chemical Company 2013, LLC, of Sterling, Kans.

Injection of solid treatment pellets can present a problem during the operation of a producing well. This is because these wells are often of relatively high pressure, ranging anywhere from 1,000-10,000 psi or above. Attempts have been made to simply dump treatment pellets into an above ground tank or sump for well fluids, but, in many instances, this expedient is unsuccessful because the pellets must be injected in a way to overcome the existing well pressures.

Pump arrangements have been devised for propelling pellets into wells, see, e.g., U.S. Pat. No. 2,790,500. The '500 patent discloses a pump arrangement wherein spherical treatment balls are mechanically propelled into a flow line using a spring-loaded piston assembly. This type of device is not suitable for elongated pellets, which are commonly produced today, and moreover does not generate adequate forces for very high pressure wells.

There is accordingly a need in the art for improved apparatus and methods for the injection of solid well treatment pellets of any type, and which overcomes the drawbacks of the prior art.

SUMMARY OF THE INVENTION

The present invention overcomes the problems outlined above and provides methods and apparatus for injecting solid treatment pellets into a downhole well, such as a producing oil or gas well. Generally speaking, the method involves generating a pressurized flow of liquid in a conduit directed to the well, and causing solid pellets to be drawn into and entrained in the pressurized flowing liquid. The pressure of the flowing liquid is greater than the well pressure of the producing well, so that the pellets can be successfully injected. Typically, the pressurized liquid is in the form of water, and a multiple-stage positive displacement pump (e.g., a triplex pump) is used to generate the necessary pressure in the flowing liquid. Preferably, the pellets (which may be spherical or, more usually, of elongate shape) are placed with a charge pot having an exit line in communication with the conduit. As such, the pellets are entrained in the liquid for ultimate delivery to the well.

The overall injection apparatus includes a source of liquid and a pump operably coupled with the liquid source for generating a pressurized flow of liquid, and to pass the pressurized flow of liquid into a transfer conduit. A container operable to hold the injection pellets is also provided, having an output line operably connected with the conduit so that the pellets may be withdrawn from the container and entrained within the pressurized flow of liquid in the conduit.

The output end of the transfer conduit may be directed into the well casing at the well head, or at any other suitable well location. The solid pellets will be successfully injected, so long as the pressure of the liquid in the conduit exceeds the well pressure. Advantageously, the entire injection apparatus is mounted on a mobile vehicle

BRIEF DESCRIPTION OF THE DRAWINGS

FIG. 1 is a schematic representation of the pellet injection apparatus of the present invention;

FIG. 2 is a schematic representation similar to that of FIG. 1, but illustrating the operation of the apparatus during pellet injection into a high pressure well;

FIG. 3 is a view similar to that of FIG. 1, but illustrating the operation of the apparatus during flushing of the pellet charge pot; and FIG. 4 is a view similar to that of FIG. 1, but illustrating the operation of the apparatus wherein high pressure liquid is directed through the charge pot and also into an operating well.

DETAILED DESCRIPTION OF THE PREFERRED EMBODIMENT

Turning now to the drawings, and particularly FIG. 1, an injection apparatus 10 is illustrated which includes anon-potable water storage tank 12 and a triplex pump 14 with a water transfer line 16 interconnected between the tank 12 and the inlet of pump 14. The line 16 is equipped with an intermediate gear pump 18, as well as conventional valves 20, 22, which serves to transfer water from tank 12 to the inlet of pump 14. The outlet of triplex pump 14 is connected to a conduit 24 which extends to a connection site at an operating well 25. The conduit 24 is equipped with valves 26 and 28, as shown The overall apparatus additionally includes a pellet container or "charge pot" 30, which is designed to hold a supply of the pellets to be injected into the producing well. The charge pot 30 has a pellet output line 32 with an intermediate valve 34. As illustrated, the end of line 32 is operably coupled to and communicates with conduit 24. The container 30 also has a water input line 36 with an intermediate valve 38; as illustrated, the inlet line is also operably connected to and in communication with conduit 24. The container 30 has a removable cap or lid 40 allowing introduction of well pellets into the container.

FIG. 2 illustrates operation of the apparatus 10 during injection of pellets into the producing well 25. In this condition, the container 30 has a supply of pellets therein and the valves 20, 22 are opened with pump 18 operating so that water is delivered to the inlet of pump 14. In addition, the valves 26, 28, and 34 are open and valve 38 is closed. Thus, the transfer of water from tank 12 to pump 14 is illustrated by arrows 42, and the flow of pressurized fluid from the outlet of pump 14 is depicted by arrows 44. The flow of pressurized water through conduit 24 serves to draw or siphon pellets from container 30, as illustrated by arrow 46, so that the pellets first become entrained within the pressurized flow of water leading to well 25 downstream of the connection between output line 32 and conduit 24. If needed, water may be present in the container 30 to facilitate the passage of the pellets from the container.

Another operational sequence of apparatus 10 is illustrated in FIG. 3. In this instance, the valves 20, 22, 26, and 34 are open, and valve 28 is closed. Accordingly, water is drawn from tank 12 and is delivered to the inlet of pump 14. The pressurized flow from the output of pump 14 travels through conduit 24 and is then diverted via line 36 for passage into container 30, with the pressurized flow of liquid exiting container 30 through line 32. In this mode, the pellets within container 30 are entrained with the pressurized flow of liquid by passage thereof through the container. This operation is less favored than that of FIG. 2, but may also be used with no pellets within container 30, in order to flush the system.

FIG. 4 depicts a still further operational mode wherein all of the valves 20, 22, 26, 34, and 38 are open. Thus, the pressurized flow of liquid from pump 14 passes through the container 30 via lines 36 and 32, and also passes through the conduit 24, as in the case of the FIG. 1 embodiment. In this sequence, the pellets within container 30 are entrained by virtue of the pressurized flow of water through container 30, and also as a consequence of the pressurized flow of water through the conduit 24.

It will be appreciated that in any of the above-described operations, well treatment pellets are entrained within the pressurized flow of water so that they may be successfully introduced into the well 25.

We claim:

1. A method of injecting solid treatment pellets into a downhole well comprising the steps of first generating a pressurized flow of liquid in a conduit using a pump having an inlet and a pressurized liquid outlet, thereafter causing solid pellets to be entrained in said pressurized flowing liquid at a point downstream of said pump outlet, and then directing the pressurized flowing liquid and said entrained pellets from said conduit into said well, said entrainment-causing step comprising the steps of placing said pellets within a container having a liquid inlet line in communication with said conduit and a pellet outlet line in communication with said conduit, and causing pressurized liquid to flow into said container through said inlet line in order to entrain said pellets within the pressurized liquid, said pressurized flowing liquid within the conduit operable to draw off said pellets from said container through said pellet outlet line.

2. The method of claim 1, said liquid being water.

3. The method of claim 1, said pump being a positive displacement pump.

4. The method of claim 3, said positive displacement pump being a triplex pump.

5. Injection apparatus operable to inject solid pellets into a pressurized downhole well, said apparatus comprising:

a pump configured to be operably coupled with a source of liquid for generating a pressurized flow of the liquid, and for passing the pressurized flow of liquid into a conduit, said pump having an inlet and a pressurized liquid outlet coupled with said conduit; and a container operable to hold injection pellets and having an output line, said output line and conduit being connected at a point downstream of said pump outlet so that the flow of said pressurized liquid through the conduit will cause the pellets to be entrained within said flow of pressurized liquid, for delivery to said well, said container having an input line also operably connected with said conduit for passage of said pressurized liquid through said container, whereby said pellets will be entrained within the pressurized liquid passing through the container.

6. The apparatus of claim 5, said liquid source being a supply of water.

7. The apparatus of claim 5, said pump being a positive displacement pump.

8. The apparatus of claim 5, said apparatus being mounted on a mobile vehicle.

9. A method of injecting solid treatment bodies into a downhole well comprising the steps of first generating a pressurized flow of liquid in a conduit using a pump having an inlet and a pressurized liquid outlet, thereafter causing solid bodies to be entrained in said pressurized flowing liquid at a point downstream of said pump outlet, and then directing the pressurized flowing liquid and said entrained bodies from said conduit into said well, said entrainment-causing step comprising the steps of placing said bodies within a container having a liquid inlet line in communication with said conduit and a body outlet line in communication with said conduit, and causing pressurized liquid to flow into said container through said inlet line in order to entrain said bodies within the pressurized liquid, said pressurized flowing liquid within the conduit operable to draw off said bodies from said container through said body outlet line.

10. The method of claim 9, said treatment bodies being pellets.

* * * * *